US009322546B1

(12) United States Patent
Morales et al.

(10) Patent No.: US 9,322,546 B1
(45) Date of Patent: Apr. 26, 2016

(54) ILLUMINATABLE DRAIN PLUG

(71) Applicants: Alonzo Morales, Cottage Grove, OR (US); Jason B. Rains, Cottage Grove, OR (US); Vaughn Z. Rains, Lakeside, OR (US)

(72) Inventors: Alonzo Morales, Cottage Grove, OR (US); Jason B. Rains, Cottage Grove, OR (US); Vaughn Z. Rains, Lakeside, OR (US)

( * ) Notice: Subject to any disclaimer, the term of this patent is extended or adjusted under 35 U.S.C. 154(b) by 61 days.

(21) Appl. No.: 13/684,366

(22) Filed: Nov. 23, 2012

(51) Int. Cl.

| | |
|---|---|
| ***F21V 29/00*** | (2015.01) |
| ***F21V 33/00*** | (2006.01) |
| ***F21L 4/00*** | (2006.01) |
| ***F21L 4/02*** | (2006.01) |
| ***F21L 4/08*** | (2006.01) |
| ***F21V 31/00*** | (2006.01) |

(52) U.S. Cl.
CPC ..... *F21V 33/004* (2013.01); *F21L 4/00* (2013.01); *F21L 4/02* (2013.01); *F21L 4/08* (2013.01); *F21V 31/00* (2013.01); *F21V 31/005* (2013.01)

(58) Field of Classification Search
CPC ..... F21V 31/00; F21V 31/005; F21V 33/004; F21L 4/02; F21L 4/08
USPC ..... 362/101, 234, 253, 267, 399, 645
See application file for complete search history.

(56) References Cited

U.S. PATENT DOCUMENTS

| | | | | |
|---|---|---|---|---|
| 2,481,054 | A * | 9/1949 | Wendel | 362/267 |
| 6,443,589 | B1 * | 9/2002 | Lee | 362/318 |
| 2004/0042201 | A1 * | 3/2004 | Lee | 362/101 |

* cited by examiner

*Primary Examiner* — Y M Lee
(74) *Attorney, Agent, or Firm* — Robert E. Howard

(57) ABSTRACT

An illuminatable drain plug for use in residential or commercial water receptacles communicating with a drain pipe. The drain plug includes a base having a top, a bottom, and a cylindrical sidewall extending between the top and bottom. A circular elastomeric sealing means extends outwardly from the cylindrical sidewall of the base and adapted to fit within the drain pipe in water sealing engagement therewith. A light chimney extends upwardly from the top of the base. A light source and means for actuating the light source is located within the base. Upon actuation the light source communicates its light with the light chimney and/or base and is emitted therefrom.

15 Claims, 2 Drawing Sheets

ILLUMINATABLE DRAIN PLUG

BACKGROUND OF THE INVENTION

The present invention relates to an illuminatable drain plug for use in residential or commercial water receptacles which can be filled by use of a plug blocking access to a drain pipe. Such water receptacles include kitchen or bathroom sinks, bath tubs, laundry tubs, etc.

It has been found that by providing a drain plug which can be illuminated several desirable effects are obtained. Illumination of a drain plug under water provides a pleasing aesthetic effect in an otherwise unlighted room. Such illumination also allows a user to carry out functions for which such receptacles are normally used, such as washing dishes, washing clothing, bathing, etc., without having to illuminate the entire room, thereby saving on energy costs and providing an attractive light display.

BRIEF DESCRIPTION OF THE INVENTION

The illuminatable drain plug of the present invention is intended for use with kitchen or bathroom sinks, bath tubs, laundry tubs, etc. in a residential or commercial setting.

In a first embodiment the illuminatable drain plug includes a base and an upwardly extending transparent or translucent cylindrical portion which acts as a handle and as a "light chimney".

In a second embodiment the illuminatable drain plug includes a transparent or translucent base and an upwardly extending non-transparent or non-translucent cylindrical light chimney portion.

In a third embodiment the illuminatable drain plug includes a transparent or translucent base and an upwardly extending transparent or translucent cylindrical light chimney portion which acts as a handle and as a "light chimney".

In the first embodiment an LED light or lights and their controller means are placed in the base below the light chimney. The LED lights are positioned so as to transmit their light into the light chimney and emit light therefrom. The LED light or lights are preferably powered by a battery or batteries.

In the second embodiment LED lights and their controller are placed in the base. The LED lights are positioned so as to transmit their light into the base and emit light from the edge and/or top thereof. The LED lights and are preferably powered by a battery or batteries.

In the third embodiment and LED light or lights and their controller means are placed in the base, at least one of the lights being placed below the light chimney and adapted to illuminate the light chimney, with the remainder of the LED lights being placed in the base in locations adapted to illuminate the base.

The LED light or lights can be the same or different colors, and can be operated in a continuous or discontinuous mode.

The LED light or lights can be activated with a mechanical on/off switch, or with a sensor which activates the light or lights when the sensor is subjected to an external stimuli, such as the drain plug being brought into contact with water, subjected to water pressure, or other sensor actuating means.

The battery or batteries used to power the LED light or lights can be of the replaceable type or of the rechargeable type.

DESCRIPTION OF PREFERRED EMBODIMENTS

Figure 1:
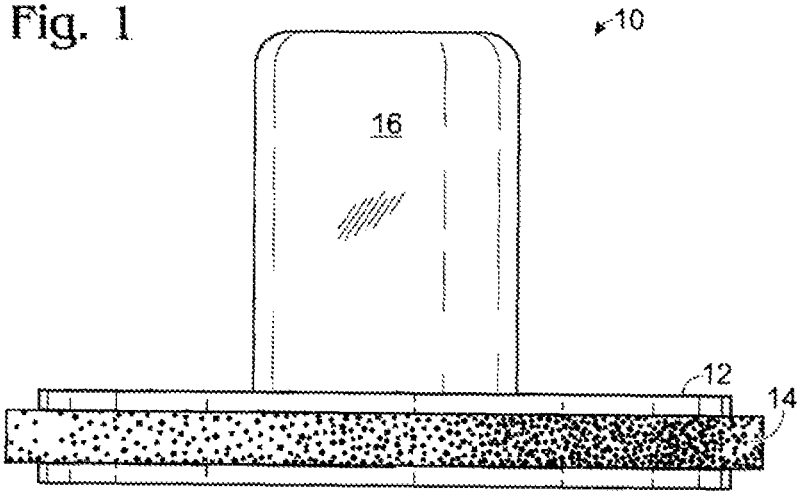
FIG. 1 is a side elevation view of the illuminated drain plug of the present invention.
Figure 2:
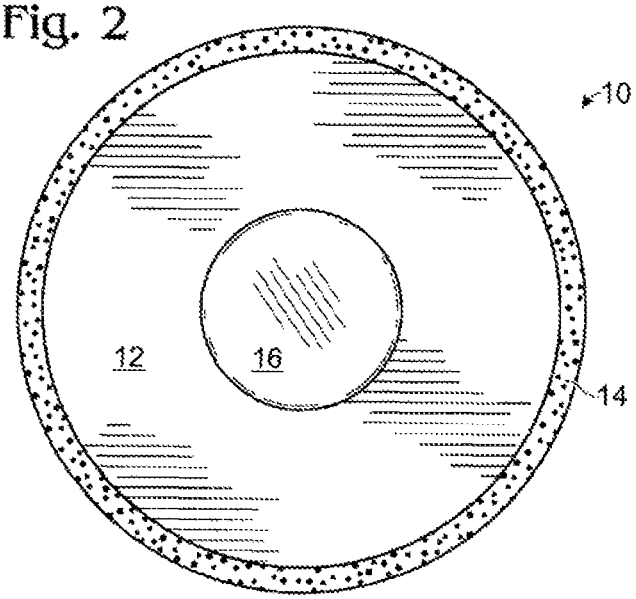
FIG. 2 is a top plan view of the illuminated drain plug.
Figure 3:
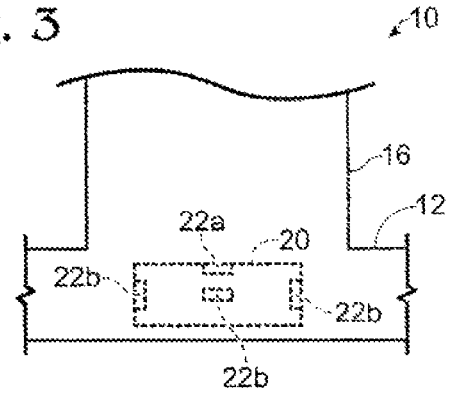
FIG. 3 is a partial side view in cross-section of the illuminated drain plug.
Figure 4:
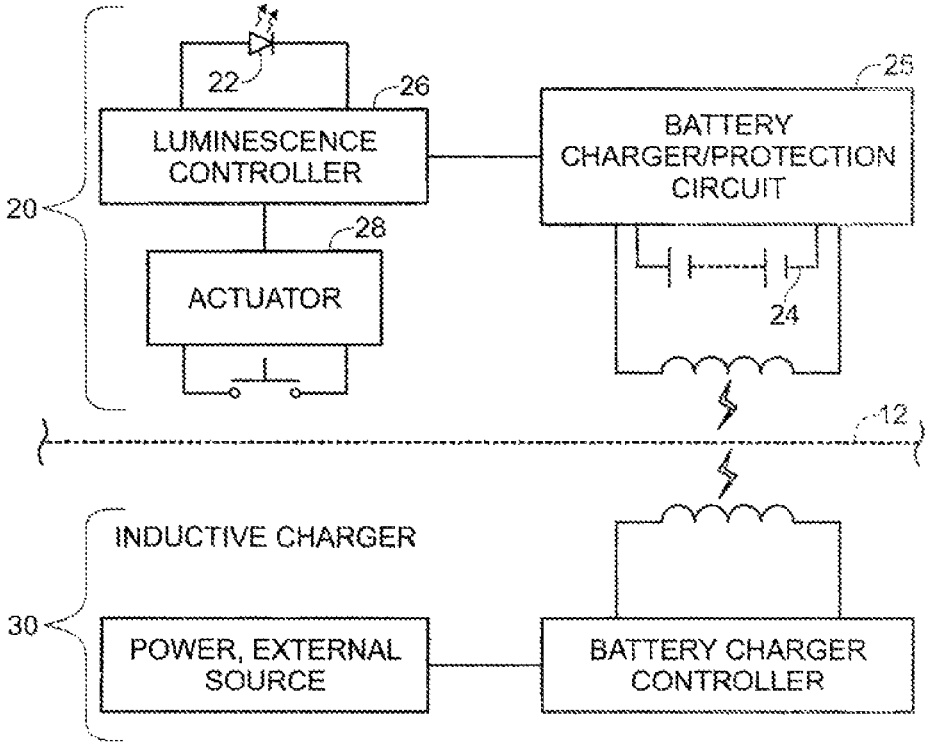
FIG. 4 is a block diagram of the illumination circuit used with the illuminated drain plug of the present invention.

The illuminatable drain plug 10 of the present invention includes a cylindrical base 12 having a circular elastomeric sealing means 14 extending outwardly from the sidewall thereof.

Elastomeric sealing means 14 can be a gasket, O-ring, or similar sealing member.

Cylindrical base 12 and circular elastomeric sealing means 14 are of a size adapted to fit within the upper portion of a drain pipe (not shown) located at the bottom of a water receptacle with elastomeric sealing means 14 being in water sealing engagement with the cylindrical wall of the drain pipe, in a manner well known in the drain plug art.

Located within cylindrical base 12 is a light generating mechanism 20. Light generating mechanism 20 preferably includes one or more LED lights 22*a* and/or 22*b*. LED lights 22*a* and/or 22*b* are powered by a DC power source, such as a battery 24. The LED lights 22*a* and/or 22*b* are supplied with DC power from power source 24 via luminescence controller 26. Luminescence controller 26 is turned on or off by actuator means 28.

Luminescence controller 26 can be programmed to vary the brightness of the LED lights 22, actuate them in a pre-selected order, pulsate them simultaneously or in a pre-selected order, or any other visually attractive sequence. LED lights 22*a* and/or 22*b* can be the same or different colors.

Actuator means 28 can be a manually operated mechanical switch, or a sensor which actuates luminescence controller 26 in response to an external stimuli, such as when the drain plug is brought into contact with water, subjected to a pre-selected water pressure, or other sensor actuating means.

In a first embodiment light chimney or pipe 16 is formed of a transparent or translucent material which allows light generated by LED lights 22*a* to be transmitted into the bottom thereof and be emitted from the cylindrical sidewall and top thereof. Light chimney or pipe 16 can be solid or hollow. Light chimney or pipe 16 also functions as a handle to allow a user to insert and remove illuminated drain plug 10 into or out of a drain.

In a second embodiment light chimney or pipe 16 is formed of a non-transparent or non-translucent material. Cylindrical base 12 is formed of a transparent or translucent material which allows light generated by LED lights 22*b* to be emitted from the cylindrical sidewall and top thereof. Cylindrical base 12 can be solid or hollow.

In a third embodiment both cylindrical base 12 light chimney or pipe 16 are formed of a transparent or translucent material which allows light generated by LED lights 22*a* and 22*b* to be emitted there from.

Battery 24 located within base 12 of illuminatable drain plug 10 and its associated charger circuit 25 can be charged without removal from base 12 by an inductive charger 30 in a manner well known in the inductive battery charging art. Alternatively, battery 24 can be of the non-rechargeable type which is replaced from time to time.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An illuminatable drain plug for use in residential or commercial water receptacles which can be filled by use of a plug blocking access to an upper portion of a drain pipe having a cylindrical wall located at a bottom of said water receptacle, said drain plug comprising:

a base having a top, a bottom, and a cylindrical sidewall extending between said top and said bottom of said base;

a circular elastomeric sealing means extending outwardly from said cylindrical sidewall of said base, said cylindrical base and said circular elastomeric sealing means adapted to fit within a drain hole of said drain pipe with said elastomeric sealing means being in water sealing engagement with said cylindrical wall of said drain pipe;

a light chimney extending upwardly from the top of said base; and a light source and means for actuating said light source located within the cylindrical sidewall of said base, said light source being configured to communicate its light via said light chimney and/or base.

2. The illuminatable drain plug of claim 1 wherein said light chimney is transparent or translucent and said light source is at least one LED light positioned to communicate its light into said light chimney.

3. The illuminatable drain plug of claim 1 wherein said base is transparent or translucent and said light source is a plurality of LED lights positioned to communicate their light into said base.

4. The illuminatable drain plug of claim 1 wherein said light chimney and said base are transparent or translucent and said light source is a plurality of LED lights positioned to communicate their light into said light chimney and said base.

5. The illuminatable drain plug of claim 1 wherein said means for actuating said light source includes a power source, an actuator, and a luminescence controller, and means for electrically communicating said power source, said actuator, and said luminescence controller.

6. The illuminatable drain plug of claim 5 wherein said power source is at least one battery.

7. The illuminatable drain plug of claim 6 wherein said battery is rechargeable.

8. The illuminatable drain plug of claim 7 wherein said battery is of the type that can be recharged with an externally located inductive charger.

9. The illuminatable drain plug of claim 6 wherein said battery is replaceable.

10. The illuminatable drain plug of claim 5 wherein said actuator is a mechanical switch.

11. The illuminatable drain plug of claim 5 wherein said actuator actuates said luminescence controller in response to an external stimuli.

12. The illuminatable drain plug of claim 5 wherein said luminescence controller is programmed to vary the brightness of the light source.

13. The illuminatable drain plug of claim 5 wherein said light source is a plurality of LED lights and said luminescence controller is programmed to actuate said lights in a pre-determined order.

14. The illuminatable drain plug of claim 5 wherein said light source is a plurality of LED lights and said luminescence controller is programmed to pulsate said lights simultaneously or in a pre-selected order.

15. The illuminatable drain plug of claim 5 wherein said light source is a plurality of LED lights having varying colors.

* * * * *